US006203020B1

(12) United States Patent
Mireles, Jr. et al.

(10) Patent No.: US 6,203,020 B1
(45) Date of Patent: Mar. 20, 2001

(54) DOWNHOLE PACKER WITH ELEMENT EXTRUSION-LIMITING DEVICE

(75) Inventors: Hector H. Mireles, Jr., Spring; James C. Doane, Friendswood, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/198,896

(22) Filed: Nov. 24, 1998

(51) Int. Cl.[7] ..... F16J 15/20

(52) U.S. Cl. ..... 277/339; 277/336; 277/337; 277/338

(58) Field of Search ..... 277/336, 337, 277/338, 339, 340, 342; 166/179, 196

(56) References Cited

U.S. PATENT DOCUMENTS

| | | | | |
|---|---|---|---|---|
| 1,810,352 | | 6/1931 | Humason . | |
| 2,606,618 | | 8/1952 | Page . | |
| 2,612,953 | | 10/1952 | Morgan et al. . | |
| 2,799,348 | * | 7/1957 | Page | 277/342 |
| 3,339,637 | * | 9/1967 | Holden | 277/342 |
| 3,569,608 | * | 3/1971 | Ance . | |
| 4,321,015 | * | 3/1982 | Roeder | 277/339 |
| 4,791,992 | | 12/1988 | Greenlee et al. . | |

OTHER PUBLICATIONS

Advertisement for Halliburton Perma–Lach Packer, 1 page, date unknown.

Advertisement for Arrowset I–X Retrievable Production Packer, 1 page, date unknown.

* cited by examiner

*Primary Examiner*—Anthony Knight
*Assistant Examiner*—Enoch E. Peavey
(74) *Attorney, Agent, or Firm*—Duane, Morris & Heckscher LLP

(57) ABSTRACT

A sealing element system for a downhole packer reduces the tendency of the elements to extrude. Mechanical limits are provided to the amount of force that can be passed onto the uppermost and lowermost components of a sealing element system by providing a limit on the longitudinal compression available against a gauge ring. The gauge rings are roughened to also grab the uppermost and lowermost elements to fight the tendency to extrude. The uppermost and lowermost elements are configured with an external groove to control the way they deform into a sealing relationship with the tubing and casing so that extrusion into the gap is reduced.

16 Claims, 1 Drawing Sheet

DOWNHOLE PACKER WITH ELEMENT EXTRUSION-LIMITING DEVICE

FIELD OF THE INVENTION

The field of this invention relates to downhole packers, particularly mechanically set packers which are used in high-temperature and high-pressure applications.

BACKGROUND OF THE INVENTION

A common problem with downhole packers is extrusion of the element into an annular gap between the packer body and the tubing or casing. The amount of extrusion is a function of the differential pressure, working temperature, and size of the gap to the casing inside diameter. The pressure and temperature rating of a packer is often determined at a time when the packing element has been pushed completely through the extrusion gap and begins to leak.

In the past, various metal rings or garter springs embedded in the elements at the top and/or bottom have been used to try to prevent extrusion of the packing elements. However, these techniques for reducing extrusion are undesirable in a mechanically set packer because the packer will not be resettable with these features. It is, therefore, desirable in a mechanically set packer that it be fully resettable in case the packer is accidentally set in the wrong location and needs to be moved.

Accordingly, the object of the present invention is to provide a configuration for the sealing element system, particularly usable in a mechanically set packer, which minimizes extrusion in high-temperature and high-pressure applications. Another objective is to accomplish a reduction of extrusion by limiting the forces applied to the top and bottom components of the packing element assembly in a packer. Another object is to configure the uppermost and/or lowermost components of a packing element system in a packer so as to discourage extrusion when set. Yet another object is to configure the surrounding gauge rings in a manner to further reduce the tendency to extrude. These objects will be readily understood by those skilled in the art by a review of the detailed description of the preferred embodiment below.

SUMMARY OF THE INVENTION

A sealing element system for a downhole packer reduces the tendency of the elements to extrude. Mechanical limits are provided to the amount of force that can be passed onto the uppermost and lowermost components of a sealing element system by providing a limit on the longitudinal compression available against a gauge ring. The gauge rings are roughened to also grab the uppermost and lowermost elements to fight the tendency to extrude. The uppermost and lowermost elements are configured with an external groove to control the way they deform into a sealing relationship with the tubing and casing so that extrusion into the gap is reduced.

DETAILED DESCRIPTION OF THE PREFERRED EMBODIMENT

Figure 1:
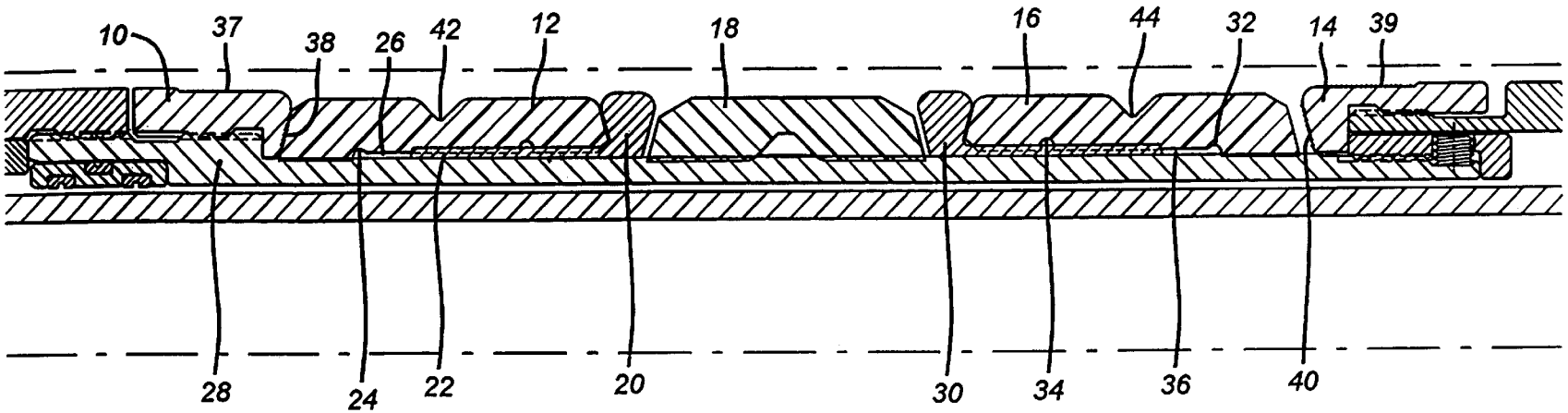
FIG. 1 is a sectional view of a three-element system for a packer sealing assembly, illustrating the run-in condition.

FIG. 1 illustrates a packing element system for a packer, preferably mechanically set. The other features of the packer are all of known designs and do not constitute any portion of the invention and, therefore, are eliminated from the drawing as items known to all those skilled in the art. Referring to FIG. 1, an upper gauge ring 10 is secured above upper element 12, while a lower gauge ring 14 is mounted below lower element 16. Central element 18 is positioned between upper element 12 and lower element 16. Separating central element 18 and upper element 12 is a stop ring 20. Stop ring 20 has a long, thin, cylindrical component 22 which fits in a recess 24 on the inside of upper element 12. Recess 24 as shown in FIG. 1 is longer than cylindrical component 22, thus leaving an initial gap 26 between the upper element 12 and sleeve 28. Another stop ring 30 is disposed between lower element 16 and central element 18 and forms a mirror image with respect to stop ring 20. As before, the lower element 16 has a recess 32, and the stop ring 30 has a cylindrical component 34 which extends into recess 32. Recess 32 is longer than cylindrical component 34, leaving an initial gap 36 between lower element 16 and sleeve 28.

Gauge ring 10 has a roughened surface 38 and wicker threads 37 which engages the upper element 12 to assist in resistance against extrusion. Similarly, lower gauge ring 14 has a roughened surface 40 and wicker threads 39 to contact the lower sealing element 16 to resist extrusion around the gauge ring 14. Upper element 12 has an external groove 42 to control the deformation of upper element 12 as a compressive force is applied to it, with the idea being that extrusion around the upper gauge ring 10 is minimized due to the tendency of the upper element to buckle adjacent groove 42 as it is being longitudinally compressed. Similarly, the lower sealing element 16 has a groove 44 for the same purpose.

Figure 2:
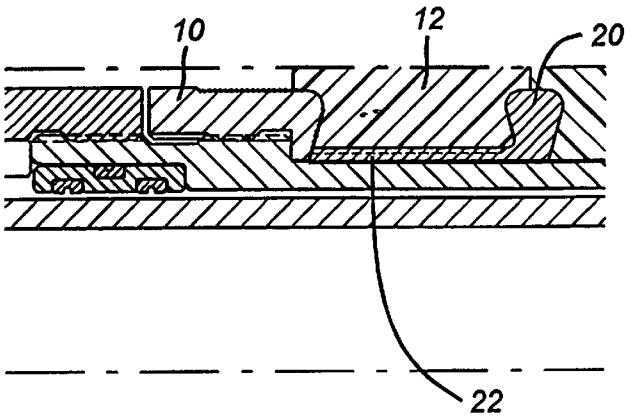
FIG. 2 is a view of the uppermost element in the system shown in FIG. 1 after a compressive force has been applied to the elements to set it against the casing or tubing.

The shapes of grooves 42 and 44 and their position along the upper element 12 and lower element 16, respectively, can be varied without departing from the spirit of the invention. The number of sealing elements can also be varied without departing from the spirit of the invention. The improvement in the ability of the packer having such a sealing system, as shown in FIG. 1, to withstand high operating temperatures and differential pressures comprises in the use of one or more stop rings, such as 20 or 30, to place a definitive limit on the applied compressive force by limiting longitudinal compression to an element that abuts either an upper or a lower gauge ring, such as 10 or 14. FIG. 2 illustrates the stop ring 20 with its cylindrical component 22 abutting the upper gauge ring 10. The same final position is reached at the other end of the sealing system as between stop ring 30 and lower gauge ring 14. It can be seen that in the instance of, for example, the upper sealing element 12 shown in FIG. 2 in the compressed state, the amount of compression applied to this sealing element is limited by the distance between the end of the cylindrical component 22 and the gauge ring 10. That initial distance determines how far the stop ring 20 can be pushed against upper element 12 before no further compressive forces to upper element 12 can be applied as the cylindrical component 22 reaches its travel limit against the upper gauge ring 10.

Working in conjunction with the force-limiting effect of the cylindrical component 22 is the roughened surface 38 and wicker threads 37 on the gauge ring 10, which can be accomplished in a variety of ways. The surface can be mechanically abraded or it can have a material applied to it which includes, for example, a combination of epoxy and grit to assist the grip of the upper gauge ring 10 on the upper sealing element 12. Those skilled in the art will appreciate that the entire discussion with regard to the upper gauge ring 10 and upper sealing element 12 is equally applicable at the other end of the assembly with regard to lower gauge ring 14 and lower sealing element 16.

In the preferred embodiment, the sealing elements 12, 16 and 18 are made of a carboxylated nitrile, preferably having a hardness minimum of 93 measured on the Shore A scale. With the configuration illustrated in FIGS. 1 and 2, differential pressures of over 10,000 psi at temperatures in excess of 350° F. can be handled without significant extrusion so that the assembly illustrated in FIGS. 1 and 2 which, when put on a mechanically set packer, can facilitate resetting without problems.

Those skilled in the art can now see that a packing element system has been described which will effectively operate in high-pressure differentials and high operating temperatures. The extrusion of the sealing elements at either gauge ring 10 or 14 is minimized in three different ways. First, the use of the stop rings 20 and 30 puts a definitive limit on the amount of longitudinal compression applied to those sealing elements which abut either gauge ring 10 or 14. Additionally, the roughening of the gauge ring surfaces further aids in resistance of extrusion into the gap around the gauge rings 10 or 14. Thirdly, the external groove on the lowermost or uppermost sealing element promotes buckling at that point which, alone or in combination with the adjacent stop ring, further controls the deformation of the sealing element adjacent a given stop ring so as to force it to compress in a manner which also resists extrusion into the gap around a given gauge ring. These features, combined with a suitable choice of materials, such as carboxylated nitrile, yield a sealing system particularly for a mechanically set packer which will enable it to withstand significant pressure differentials and operating temperatures.

The foregoing disclosure and description of the invention are illustrative and explanatory thereof, and various changes in the size, shape and materials, as well as in the details of the illustrated construction, may be made without departing from the spirit of the invention.

What is claimed is:

1. A packer sealing system, comprising:

a body;

at least one sealing element movable between a retracted and a set position;

at least one gauge ring to contact said sealing element on a first end thereof;

at least one stop ring to contact said sealing element on a second end opposite said first end of said sealing element;

said stop ring configured to limit longitudinal compression of said sealing element against said gauge ring when compressed from said retracted to said set position by virtue of engagement to said gauge ring;

said stop ring comprises a body to contact said sealing element and an extending portion from said body oriented toward said gauge ring;

said sealing element is formed having an inner surface defining a recess;

said extending portion is disposed in said recess.

2. The system of claim 1, wherein:

said extending portion has a shorter length than the length of said sealing element.

3. The system of claim 2, wherein:

said extending portion is cylindrically shaped.

4. The system of claim 1, wherein:

said recess is longer than said extending portion.

5. The system of claim 4, wherein:

said recess and said extending portion comprise cylindrical shapes.

6. The system of claim 1, wherein:

said gauge ring comprises a roughened surface in contact with said first end of said sealing element.

7. The system of claim 6, wherein:

said sealing element comprises an outer sealing surface which is formed defining a groove.

8. The system of claim 1, wherein:

said sealing element comprises an outer sealing surface which is formed defining a groove.

9. The system of claim 1, wherein:

said at least one sealing element comprises at least an upper and lower sealing elements;

said at least one gauge ring comprises an upper and lower gauge rings;

said at least one stop ring comprises an upper and lower stop rings, each having their extending segments extend in opposite directions;

whereupon movement of said gauge rings toward each other, said extending portion of said upper stop ring contacts said upper gauge ring to limit longitudinal compression of said upper sealing element, while said extending portion of said lower stop ring contacts said lower gauge ring to limit longitudinal compression of said lower sealing element.

10. The system of claim 9, wherein:

said extending portions are cylindrically shaped and are respectively disposed in a recess defined by an interior surface of said upper and lower sealing elements.

11. The system of claim 10, further comprising:

a central sealing element disposed between said upper and lower stop rings;

said gauge rings comprising a surface roughness to engage respectively said upper and lower sealing elements to assist in resisting extrusion.

12. The system of claim 11, wherein:

said upper and lower sealing elements comprise an outer surface which is formed having a groove thereon; and said surface roughness comprises wickers on at least an exterior surface of said gauge rings.

13. An anti-extrusion method for sealing elements for a packer, comprising:

providing at least one sealing element on a packer body;

providing at least one gauge ring at one end of the sealing element;

limiting the amount of longitudinal compression which can be applied to the sealing element against the gauge ring;

using at least one stop ring on the opposite end from said gauge ring;

providing an extending segment on said stop ring;

allowing the extending segment to contact the gauge ring to limit compression of the sealing element by the stop ring;

providing a recess between the packer body and the sealing element:

forming the extending segment as a cylindrical shape having a shorter length than the sealing element;

disposing the cylindrical shape in the recess.

14. The method of claim 13, further comprising:

roughening at least a portion of the exterior of the gauge ring with wickers which contact the sealing element after the sealing element is compressed to resist extrusion.

15. The method of claim 13, further comprising:

providing an external groove on the sealing element.

16. The method of claim 13, further comprising:

providing an upper and lower gauge ring, sealing element, and stop rings;

disposing at least one central element between said upper and lower stop rings;

orienting the extending segments of said stop rings in opposite directions toward said upper and lower gauge rings;

moving the gauge rings together until said extending segments respectively contact the upper and lower gauge rings.

* * * * *